US005477718A

United States Patent [19]

Sakamoto et al.

[11] Patent Number: 5,477,718

[45] Date of Patent: Dec. 26, 1995

[54] ROTARY APPARATUS FOR REMOVING A HABITUAL TENDENCY OF AN ELECTRIC WIRE

[75] Inventors: Yoshiei Sakamoto; Tatuya Sawaguchi, both of Iwate, Japan

[73] Assignee: Sumitomo Wiring Systems, Ltd., Mie, Japan

[21] Appl. No.: 240,120

[22] Filed: May 9, 1994

[30] Foreign Application Priority Data

May 14, 1993 [JP] Japan ..... 5-113103

[51] Int. Cl.[6] ..... B21F 1/02

[52] U.S. Cl. ..... 72/79; 72/183; 140/149

[58] Field of Search ..... 140/139, 140, 140/147, 149; 72/78, 79, 183, 371

[56] References Cited

U.S. PATENT DOCUMENTS

| | | | |
|---|---|---|---|
| 1,925,845 | 9/1933 | Moore | 140/140 |
| 2,007,345 | 7/1935 | Roberts | 140/140 |
| 2,136,714 | 11/1938 | Simons | 72/183 |
| 3,879,978 | 4/1975 | Harris, Jr. | 72/79 |
| 4,920,776 | 5/1990 | Denzler | 72/79 |

FOREIGN PATENT DOCUMENTS

| | | |
|---|---|---|
| 4-160710 | 6/1992 | Japan . |
| 290589 | 12/1928 | United Kingdom . |
| 1236725 | 6/1971 | United Kingdom . |
| 1375805 | 11/1974 | United Kingdom . |
| 1424376 | 2/1976 | United Kingdom . |
| 1502653 | 3/1978 | United Kingdom . |

*Primary Examiner*—Lowell A. Larson

*Attorney, Agent, or Firm*—Beveridge, DeGrandi, Weilacher & Young

[57] ABSTRACT

A rotary apparatus for removing a habitual tendency of an electric wire according to the present invention, has an electric wire twist removing mechanism for removing a twist of an electric wire while the electric wire is travelling. The electric wire is held by and between two-row roller groups such that the electric wire can travel. A rotary member which rotatably supports rollers of the roller groups is attached to a stationary member in a manner rotatable around an axis along the travelling direction of the electric wire. A drive mechanism rotates the rotary member at a predetermined cycle in the direction opposite to a direction in which the electric wire is twisted, thus untwisting the electric wire. Preferably, the electric wire twist removing mechanism also serves as a mechanism for correcting a bend of the electric wire.

10 Claims, 8 Drawing Sheets

ROTARY APPARATUS FOR REMOVING A HABITUAL TENDENCY OF AN ELECTRIC WIRE

CROSS REFERENCE TO RELATED APPLICATION

This application claims priority benefits under 35USC 119 of Japanese Patent Application Serial No. 5- 113103, the disclosure of which is incorporated by reference.

BACKGROUND OF THE INVENTION

1. Field of the Invention

The present invention relates to apparatus for removing a habitual tendency of an electric wire, which has an electric wire twist removing mechanism for removing a twist of an electric wire reeled out from a ring-like electric wire bundle.

2. Description of the Related Art

There is known apparatus for removing a habitual tendency of an electric wire reeled out from a ring-like electric wire bundle held by a bobbin (See Japanese Patent Laid-Open Publication 4-160710). This apparatus is arranged such that an electric wire as reeled out travels, in a zigzag manner, between two-row roller groups alternately disposed on a base, thus removing a bend of the electric wire.

It is noted that an electric wire is generally reeled out from the bobbin in a direction along the axis thereof. Accordingly, the electric wire as reeled out is spirally twisted.

In the apparatus for removing a habitual tendency of an electric wire above-mentioned, when an electric wire itself is soft, a twist of the electric wire can be removed to a certain degree while the electric wire travels between the roller groups. However, if an electric wire is hard, such a twist cannot be removed when the electric wire passes, as twisted, between the roller groups. This involves the likelihood that the electric wire still having a twist is fed to a terminal crimping device downstream in the electric wire travelling direction, causing a terminal to be defectively crimped.

SUMMARY OF THE INVENTION

It is an object of the present invention to provide a rotary apparatus for removing a habitual tendency of an electric wire, which can securely remove a twist of an electric wire even though the electric wire is rigid.

To achieve the object above-mentioned, the present invention provides an apparatus for removing a habitual tendency of an electric wire while the electric wire is fed, and this apparatus comprises a twist removing mechanism for removing a twist of an electric wire while the electric wire is fed, the twist removing mechanism including: a stationary member; a rotary member supported in a manner rotatable around a predetermined axis of rotation by the stationary member; electric wire holding means supported by the rotary member for holding the electric wire such that the electric wire can travel along the axis of rotation; a drive mechanism for rotatingly driving the rotary member; and control means adapted such that the drive mechanism rotates the rotary member at a predetermined cycle in the direction opposite to a direction in which the electric wire is twisted.

According to the arrangement above-mentioned, when the drive mechanism rotates the rotary member, the electric wire holding means is rotated as holding the electric wire such that the same can travel. Accordingly, the electric wire is twisted in such a direction as to release an original twist of the electric wire, so that the original twist of the electric wire can be removed. Therefore, even though the electric wire is hard, a habitual tendency of the electric wire can be securely removed. It is therefore possible to prevent, in a step downstream in the electric wire feeding direction, a terminal from being defectively crimped due to a twisting habit of the electric wire. It is noted that the electric wire holding means causes an electric wire to travel along the axis of rotation of the rotary member. This prevents the electric wire from being unnecessarily swung.

Preferably, the electric wire holding means comprises two-row roller groups disposed such that a travelling electric wire is held therebetween, each roller group having at least two rollers. Preferably, the rollers of the two-row roller groups are alternately disposed such that the electric wire travels in a zigzag manner for correcting a bend of the electric wire. In such an arrangement, the electric wire holding means of the twist removing mechanism causes the electric wire to travel in a zigzag manner, thus correcting a bend of the electric wire. Accordingly, the electric wire twist removing mechanism also serves as an electric wire bend correcting mechanism. Most of the component elements of both mechanisms can therefore be commonly used. Such an arrangement can be greatly simplified in structure as compared with an arrangement in which these mechanisms are independently disposed.

DETAILED DESCRIPTION OF THE PREFERRED EMBODIMENTS

The following description will discuss an embodiment of the present invention with reference to FIGS. 1 to 4.

Figure 2:
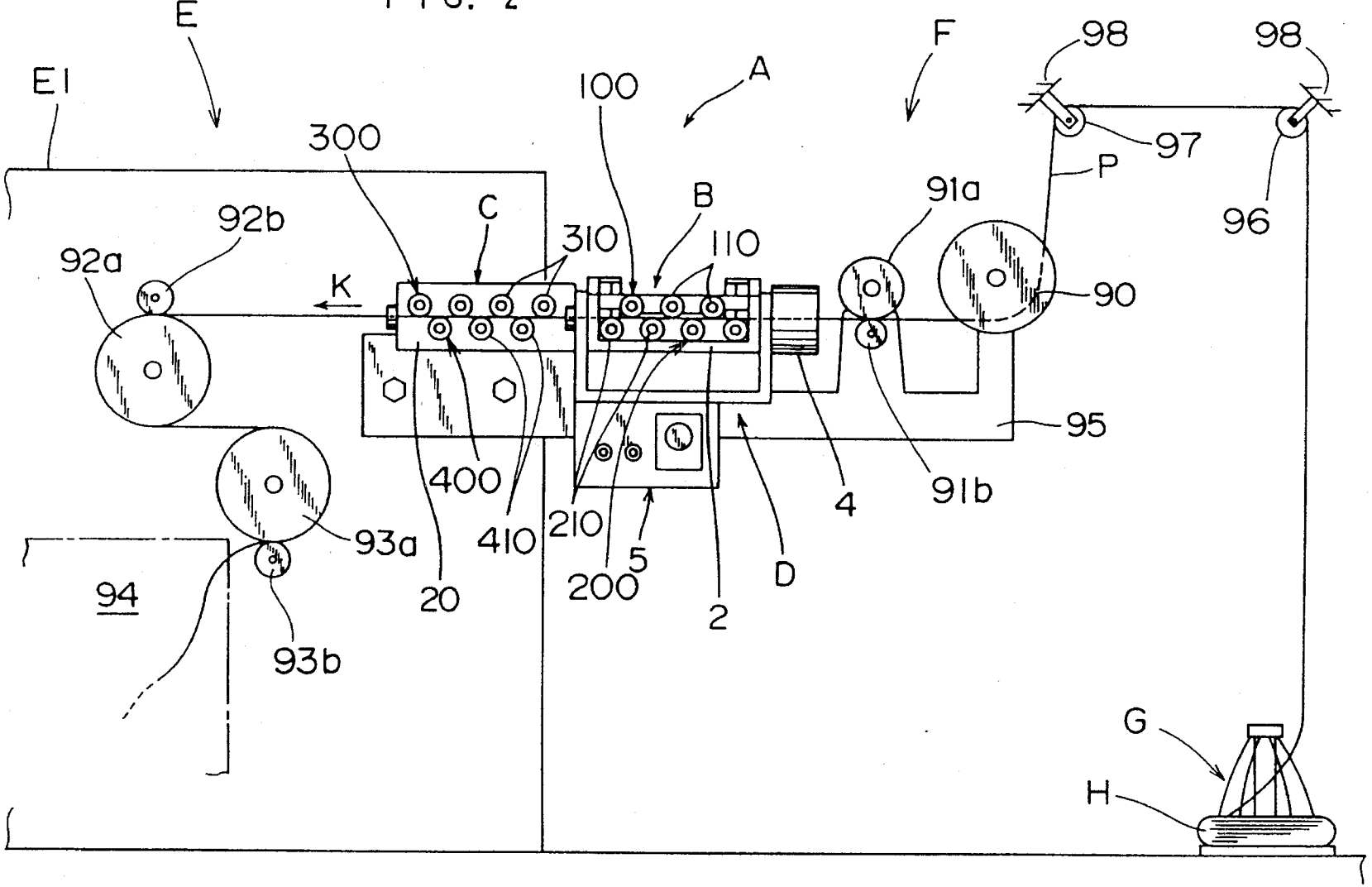
FIG. 2 is a schematic side view of an electric wire feeding block of a continuous terminal crimping machine including the rotary apparatus for removing a habitual tendency of an electric wire of the present invention.

FIG. 2 shows a continuous terminal crimping machine E in which the coated portion of an end of a coated electric wire is stripped off and in which a crimp terminal is crimped on the wire end of which coating layer has been stripped. In FIG. 2, a rotary apparatus for removing a habitual tendency of an electric wire A according to the present invention, is included in an electric wire feeding block F for feeding a coated electric wire.

An electric wire P is reeled out along an axial direction of a bobbin G from an electric wire bundle H held by the bobbin G. Provision is made such that, via a pair of guide rollers 96, 97 rotatably supported by a stationary frame 98, a guide roller 90 rotatably supported by a machine frame 95 and a pair of joint detecting rollers 91*a*, 91*b*, the electric wire P is passed through the rotary apparatus for removing a habitual tendency of an electric wire A, so that a habitual tendency of the electric wire P is removed. Thereafter, through a pair of feed rollers 92*a*, 92*b* and a pair of knurled rollers 93*a*, 93*b*, electric wires P each having a predetermined length are adapted to be temporarily stored in an electric wire reservoir 94, and fed, by a pair of draw roller pulleys (not shown), to a coating layer stripping unit (not shown) disposed at a downstream position. The feed rollers 92*a*, 92*b*, the knurled rollers 93*a*, 93*b* and the electric wire reservoir 94 are attached to the main body E1 of the continuous terminal crimping machine E, while the guide roller 90, the joint detecting rollers 91*a*, 91*b* and the rotary apparatus for removing a habitual tendency of an electric wire A are attached to the machine frame 95 secured to the main body E1.

The joint detecting rollers 91*a*, 91*b* are so arranged as to detect the passage of a naked Joint portion of the electric wire P based on electric conduction obtained between the Joint detecting rollers 91*a*, 91*b* when such a naked joint portion is passed therebetween.

Figure 1:
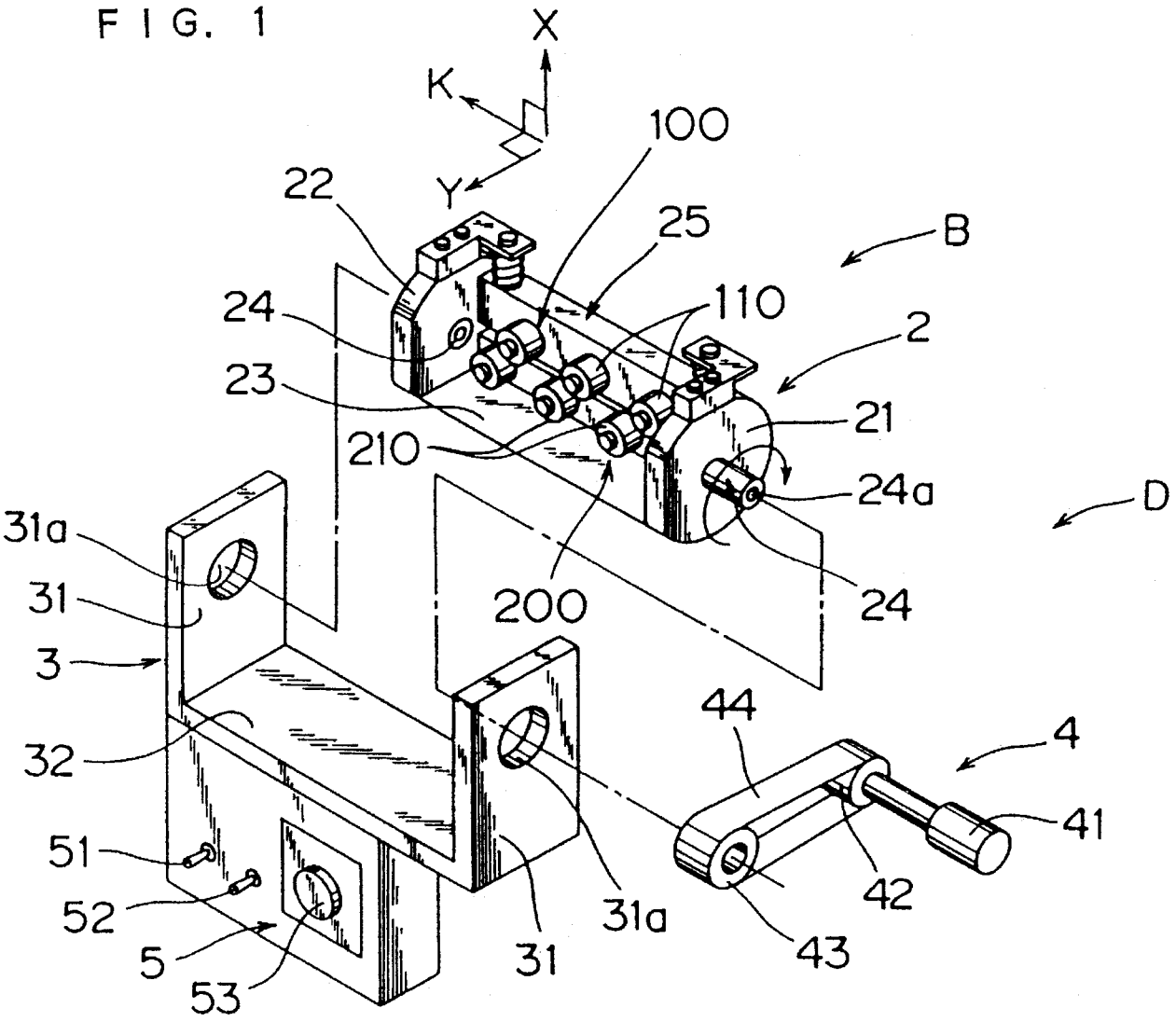
FIG. 1 is an exploded perspective view of main portions of a rotary apparatus for removing a habitual tendency of an electric wire according to an embodiment of the present invention.

FIG. 1 is an exploded perspective view of an electric wire twist removing mechanism D included in the rotary apparatus for removing a habitual tendency of an electric wire A. Referring to FIGS. 1 and 2, the apparatus A has (i) a first electric wire bend correcting mechanism B for removing a bend in transverse directions (in Y direction and counter-Y direction in FIG. 1) in a plane at a right angle to a travelling direction K of the electric wire P from the joint detecting rollers 91*a*, 91*b* (in an X–Y plane in FIG. 1), and (ii) a second electric wire bend correcting mechanism C for removing a bend in longitudinal directions (in X direction and counter-X direction in FIG. 1) in a plane at a right angle to the electric wire travelling direction K, the second electric wire bend correcting mechanism C being disposed downstream in the electric wire travelling direction K.

Referring to FIG. 2, the electric wire bend correcting mechanism C has a base member 20 made of a flat plate secured to the machine frame 95, and alternately disposed roller groups 300, 400 in two rows rotatably supported by the base member 20.

Referring to FIGS. 1 and 2, the first electric wire bend correcting mechanism B has (i) two-row, upper and lower, roller groups 100, 200 serving as electric wire holding means, which are alternately disposed in two rows and between which the electric wire P travels in a zigzag manner, and (ii) a base member 2 which rotatably supports rollers 110, 210 of the roller groups 100, 200. This embodiment is characterized in that the base member 2 of the electric wire bend correcting mechanism B in which the roller groups 100, 200 are disposed for holding the electric wire P, is rotatably supported by a stationary frame 3 secured to the machine frame 95 and that the base member 2 supported by the stationary frame 3 is intermittently rotated by a drive mechanism 4 in such a direction as to untwist the electric wire P.

With a home position of the base member 2 determined as a rotational phase position where the axes of rotation of the rollers 110, 210 are turned upward (in the X direction in FIG. 1), the base member 2 is adapted to be intermittently rotated at a predetermined cycle. With the base member 2 located in the home position, the roller groups 100, 200 disposed in the base member 2 so function as to remove a longitudinal bend of the electric wire P. FIG. 2 shows a state where the base member 2 is rotated from the home position.

Referring to FIG. 1, the base member 2 has (i) a pair of opposite lateral plates 21, 22, (ii) a connecting member 23 having a stairs-like section which connects the lateral plates 21, 22 to each other and which rotatably supports the rollers 210 of the lower roller group 200, (iii) casing shafts 24 which are integrally rotatably fitted in center holes respectively formed in the lateral plates 21, 22 and which have center holes 24*a* (See FIG. 3 which is a side view, with portions shown in section, of the wire twist removing mechanism D) into which the electric wire P is inserted, and (iv) an upper roller holding mechanism 25 for vertically displacing the upper roller group 100 in its entirety with the rollers 110 of the upper roller group 100 rotatably supported.

Figure 3:
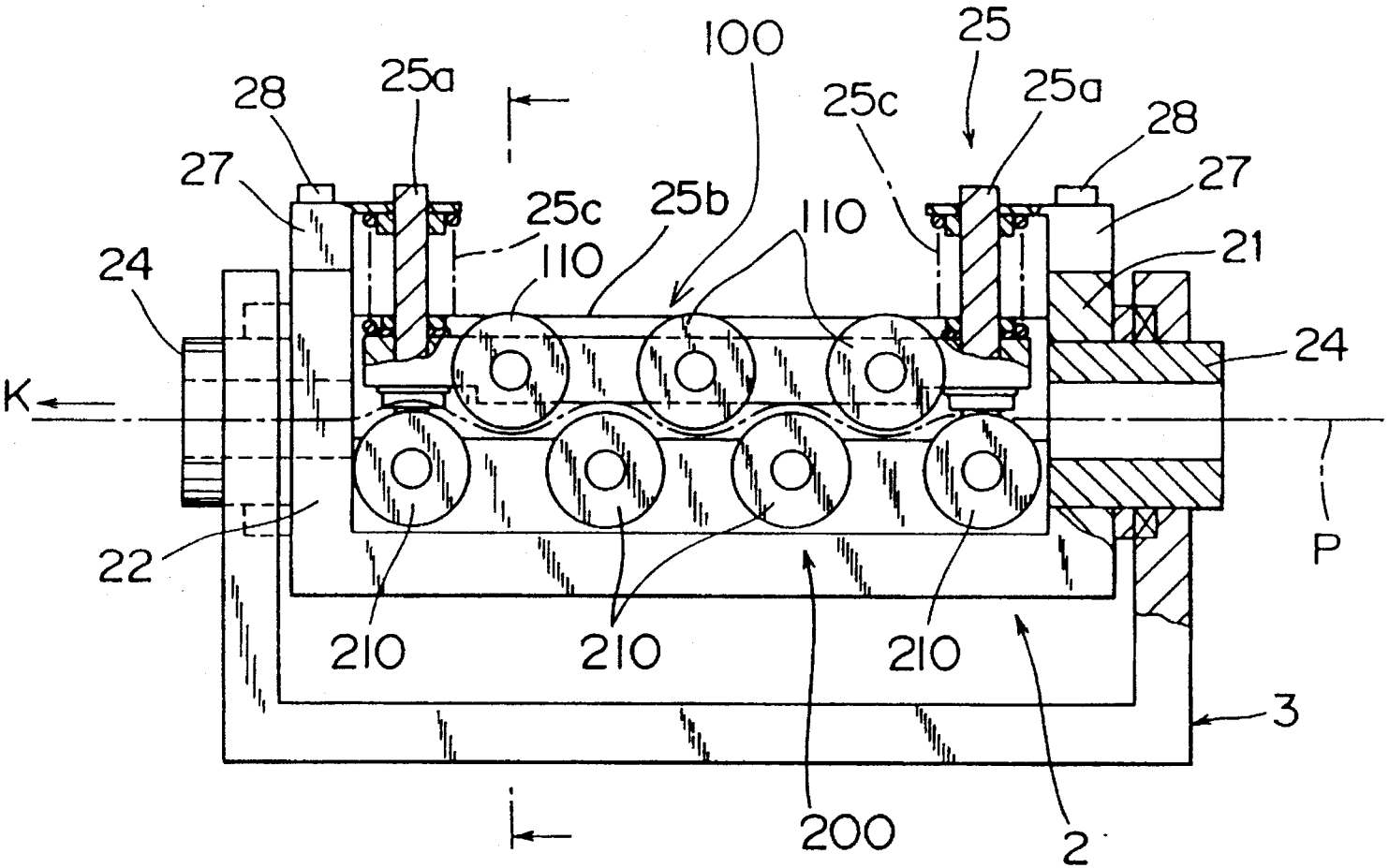
FIG. 3 is a side view, with portions broken away, of an electric wire twist removing mechanism.
Figure 4:
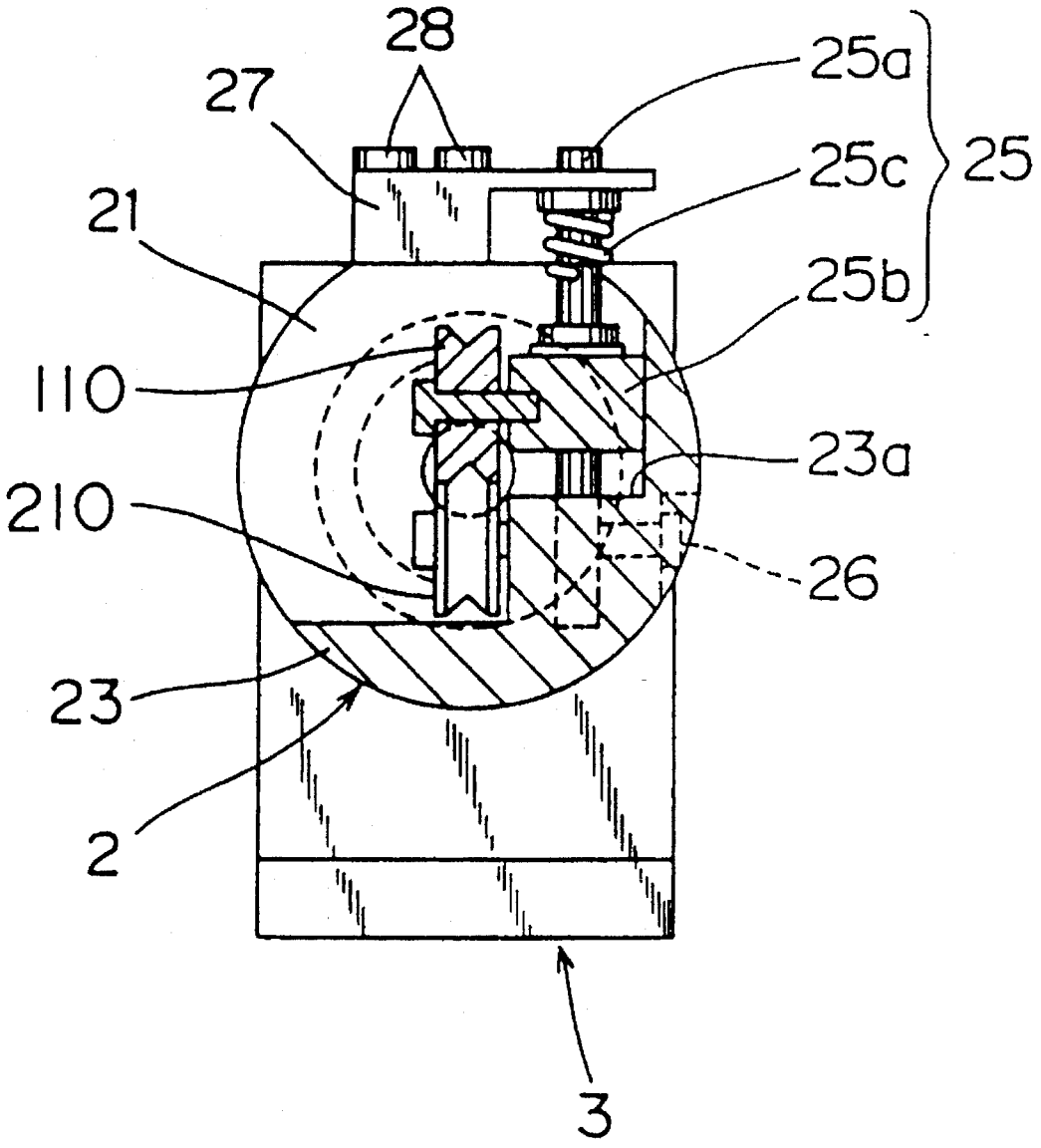
FIG. 4 is a section view taken along the line IV—IV in FIG. 3.

Referring to FIGS. 3 and 4, the upper roller holding mechanism 25 has (i) a pair of guide pins 25*a* secured to the connecting member 23, (ii) a slide member 25*b* which is slidably supported by the guide pins 25*a* and which rotatably supports the upper roller group 100, (iii) compression coil springs 25*c* for downwardly biasing the slide member 25*b*.

Referring to FIG. 3, the pair of guide pins 25*a* are disposed as standing at respective front and rear positions in the wire travelling direction. Referring to FIG. 4, the guide pins 25*a* are inserted, at the lower ends thereof, in insertion holes formed in an upper-step top surface 23*a* of the connecting member 23, and set screws 26 passing through the connecting member 23 from the rear side thereof, come in contact with the peripheral surfaces of the lower ends of the guide pins 25*a*, thus fixing the guide pins 25*a*. The slide member 25*b* is slidably inserted in the guide pins 25*a*, and the upper ends of the guide pins 25*a* are axially slidably supported by support members 27, each having an L-shape section, secured to the lateral plates 21, 22 by screws 28.

Referring to FIGS. 3 and 4, the compression coil springs 25*c* are disposed around the guide pins 25*a* and interposed between the top surface of the slide member 25*b* and the support members 27, thus downwardly biasing the slide member 25*b*. The operation of the compression coil springs 25*c* causes the upper roller group 100 to be resiliently biased downwardly. It is therefore possible to absorb variations of tension of the electric wire P which take place when the electric wire P is travelled in a zigzag manner between the upper and lower rollers 110, 210.

The wire twist removing mechanism D has (i) the roller groups 100, 200, (ii) the base member 2, (iii) the stationary frame 3 which rotatably supports the base member 2, and (iv) the drive mechanism 4 for intermittently rotating the base member 2 at a predetermined speed in such a direction that a twist of the electric wire is removed.

The stationary frame 3 is made of a plate member, having a channel section, provided with both lateral plates 31 and a bottom plate 32 which connects the lower ends of the lateral plates 31 to each other. The lateral plates 31 have casing shaft insertion holes 31*a* into which the casing shafts 24 of the base member 2 are rotatably inserted. This enables the base member 2 to be rotatable around the casing shafts 24 supported by the casing shaft insertion holes 31*a* in the stationary frame 3. While passing through the center holes 24*a* in the casing shafts 24, the electric wire P passes in a zigzag manner between the roller groups 100, 200.

The drive mechanism 4 has (i) a step motor 41 adapted to be intermittently rotated at a predetermined cycle, (ii) a driving toothed pulley 42 to be rotatingly driven in a predetermined rotational direction by the step motor 41, (iii) a follower toothed pulley 43 integrally rotatably put on the outer periphery of one of the casing shafts 24 of the base member 2, and (iv) an endless timing belt 44 wound on the pulleys 42, 43. The intermittent rotation of the step motor 41 is effected at such timing at which the base member 2 is rotated synchronously with the feed rollers 92*a*, 92*b* for travelling the electric wire. Provision is made such that the cycle of intermittent rotation is set by a cycle adjusting switch 53, to be discussed later, with the travelling speed of the electric wire P taken into consideration. More specifically, when the travelling speed of the electric wire P is fast, this increases a twist amount of the electric wire P which passes through the wire twist removing mechanism D. It is therefore required to make a setting such that the amount of rotation for untwisting the electric wire P is increased.

Figure 5:
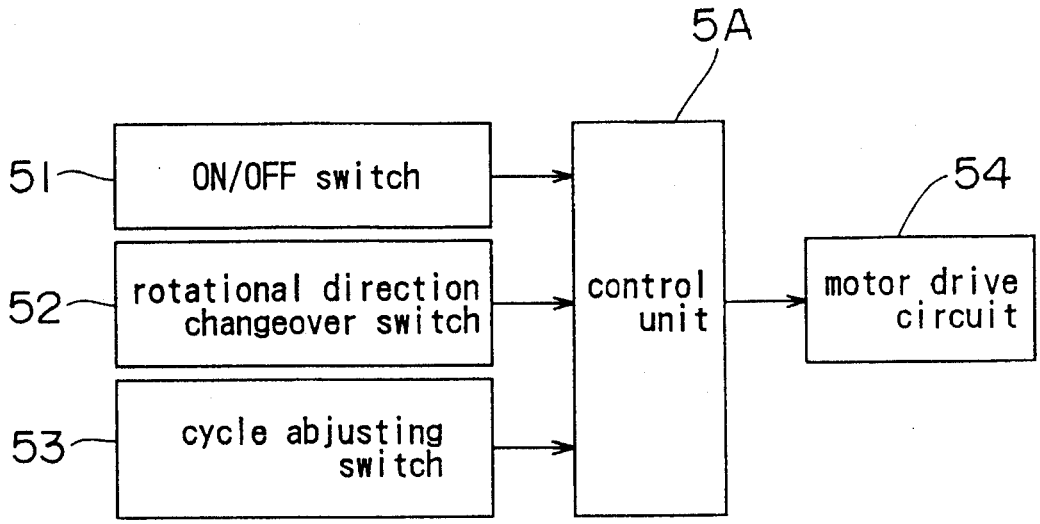
FIG. 5 is a block diagram of an electric arrangement of the rotary apparatus for removing a habitual tendency of an electric wire.

A control panel 5 is secured to the underside of the bottom plate 32 of the stationary frame 3 and has (i) an ON/OFF switch 51 for turning the step motor 41 of the drive mechanism 4 to on/off based on judgment whether or not a twist of the electric wire P is to be removed, (ii) a rotational direction changeover switch 52 for switching the rotational direction of the step motor 41 in such a direction as to untwist the electric wire P, and (iii) the cycle adjusting switch 53 for setting the cycle of intermittent rotation of the step motor 41. A control unit 5A comprising a microcomputer and the like is disposed inside of the control panel 5. Referring to FIG. 5 which is a block diagram of an electric arrangement of the control unit 5A, the control unit 5A is connected to the switches 51, 52, 53 and also connected to a motor drive circuit 54 for driving the step motor 41 of the drive mechanism 4. The control unit 5A is arranged such that, based on signals supplied from the switches 51, 52, 53, a signal is supplied to the motor drive circuit 54, thereby to control the operation of the drive mechanism 4.

This embodiment is arranged such that the base member 2 is intermittently rotated at a predetermined cycle with its home position determined as a rotational phase position where the axes of rotation of the rollers 110, 210 are turned upward (in the X direction in FIG. 1). Accordingly, when the base member 2 is located in the home position, the roller group 100 disposed in the base member 2 so functions as to remove a longitudinal bend of the electric wire P, and when the base member 2 is rotated from the home position, the roller groups 100, 200 of the base member 2 hold the electric wire P such that the electric wire P is rotated with the rotation of the base member 2. It is therefore possible to remove longitudinal and transverse bends of the electric wire P while a twist of the electric wire P is removed. Consequently, a habitual tendency of the electric wire P, can be securely removed even though the electric wire P is hard. This prevents, in a step downstream in the wire feeding direction, a terminal from being defectively crimped due to such a habitual tendency of the electric wire. According to this embodiment, the wire twist removing mechanism D is formed as including the electric wire bend correcting mechanism B. Accordingly, the mechanism D and the mechanism B can contain common component elements. Thus, as compared with an arrangement in which these mechanisms are independently disposed, this embodiment can be remarkably simplified in structure.

Further, the base member 2 is adapted to be so set by the cycle adjusting switch 53 as to be rotated at a predetermined cycle which is synchronous with the rotation of the feed rollers 92*a*, 92*b* which determines the travelling speed of the electric wire P. It is therefore possible to securely remove a twist of the electric wire P according to variations of the travelling speed of the electric wire P.

Further, when an electric wire is not twisted or when an electric wire is soft even though twisted, the ON/OFF switch 51 can be turned to off to cause the base member 2 to be immovable, so that the roller groups 100, 200 of the base member 2 can be fixed in such a position as to remove a usual longitudinal bend. In such a case, the apparatus can be handled in a manner similar to that with a conventional apparatus for removing a habitual tendency of an electric wire.

The present invention is not limited to the embodiment above-mentioned. For example, the wire twist removing mechanism D may be arranged such that the base member 2 is not intermittently rotated but is continuously rotated at a constant speed.

Figure 6:
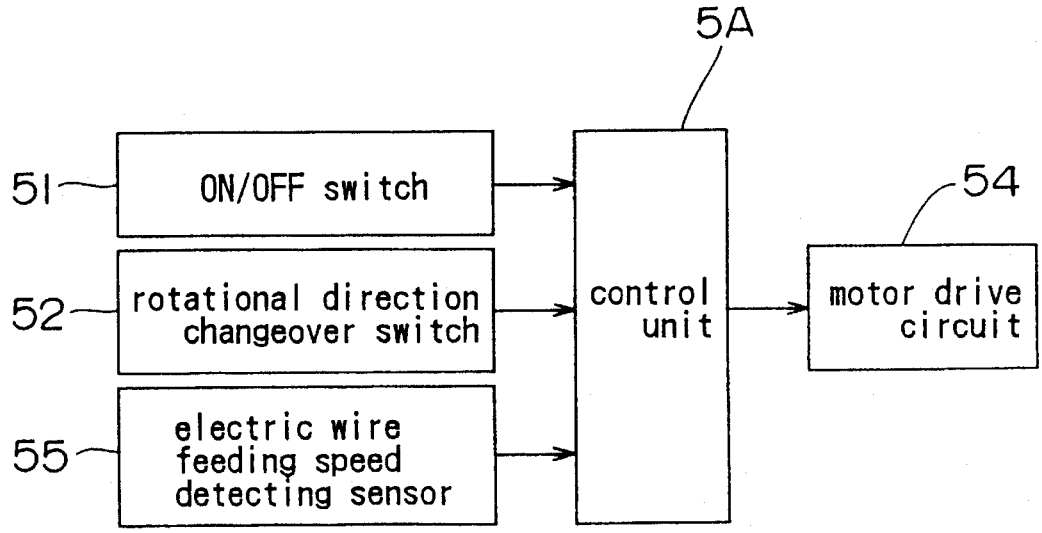
FIG. 6 is a block diagram of an electric arrangement of a rotary apparatus for removing a habitual tendency of an electric wire according to another embodiment of the present invention.
Figure 7:
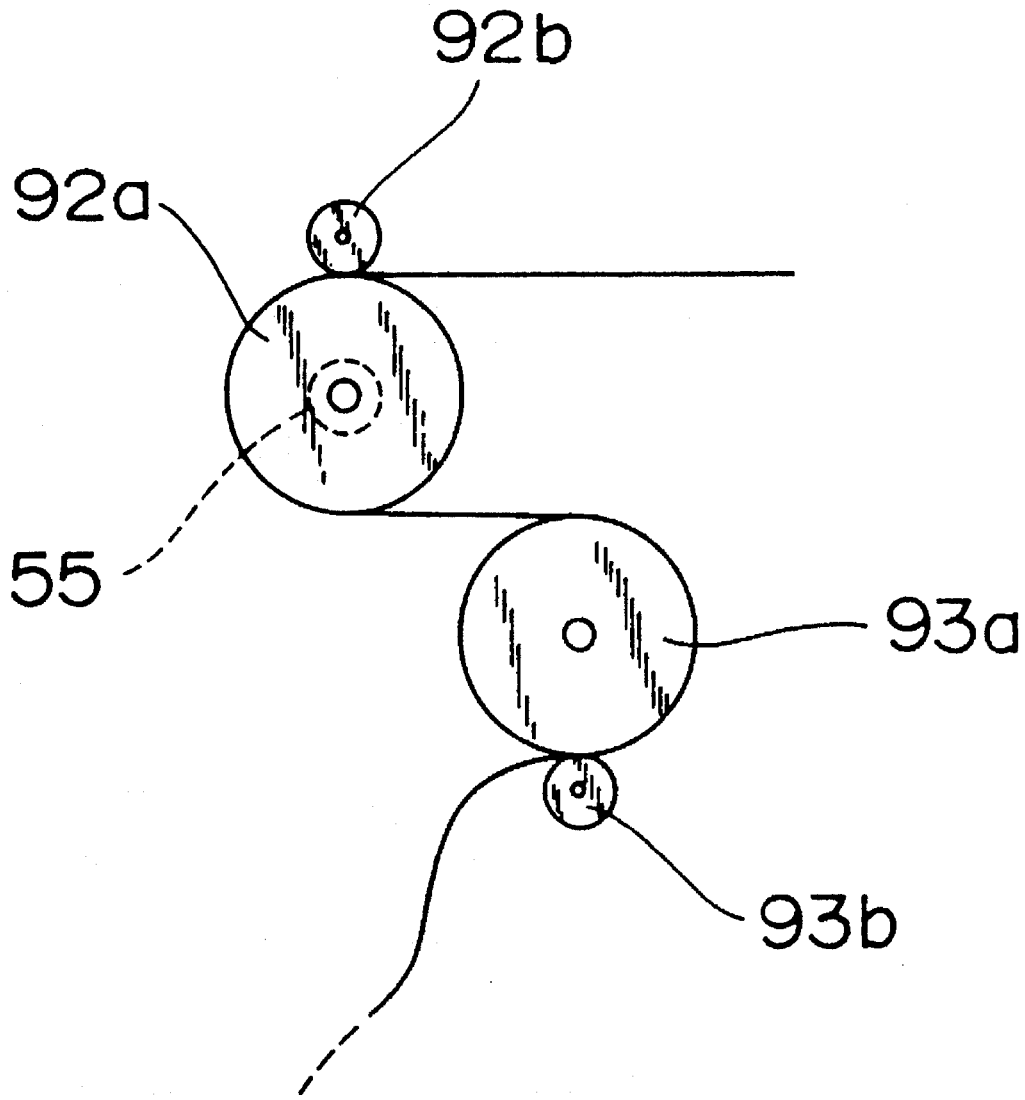
FIG. 7 is a schematic side view of main portions of a rotary apparatus for removing a habitual tendency of an electric wire, which apparatus includes a sensor for detecting the feeding speed of an electric wire.

In the embodiment above-mentioned, the cycle adjusting switch 53 is disposed to adjust the rotational cycle of the base member 2 according to the travelling speed. As shown in FIG. 6, however, an electric wire feeding speed detecting sensor 55 may be disposed to directly detect the travelling speed of an electric wire, and the rotational cycle may be automatically adjusted according to such detection. In such a case, as shown in FIG. 7, an encoder for detecting the rotational speed of the feed roller 92*a* may be used as an example of the electric wire feeding speed detecting sensor 55.

Figure 8:
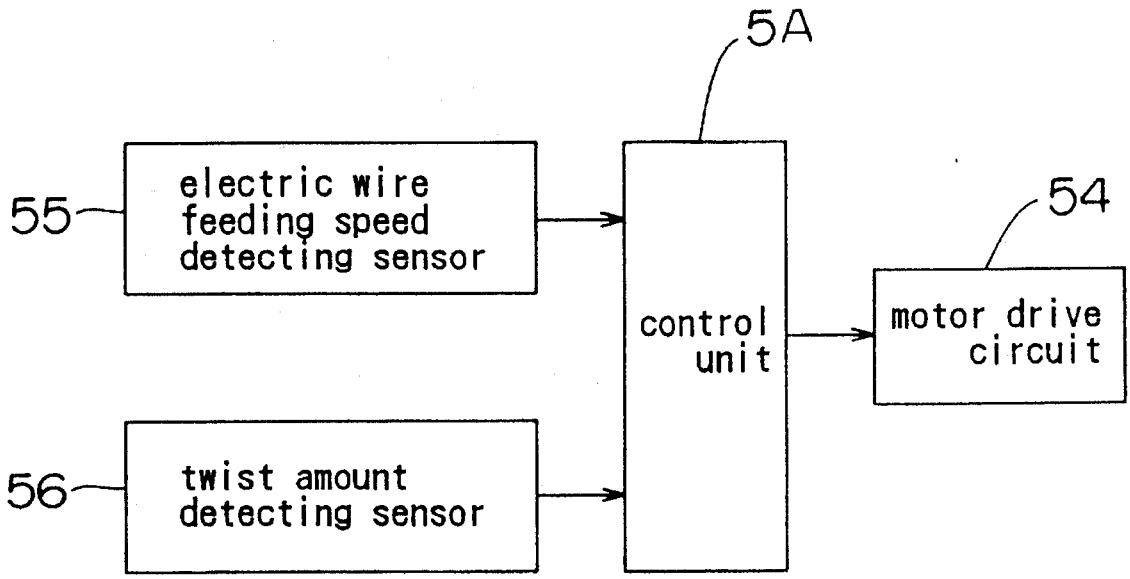
FIG. 8 is a block diagram of an electric arrangement of a rotary apparatus for removing a habitual tendency of an electric wire according to a further embodiment of the present invention.
Figure 9:
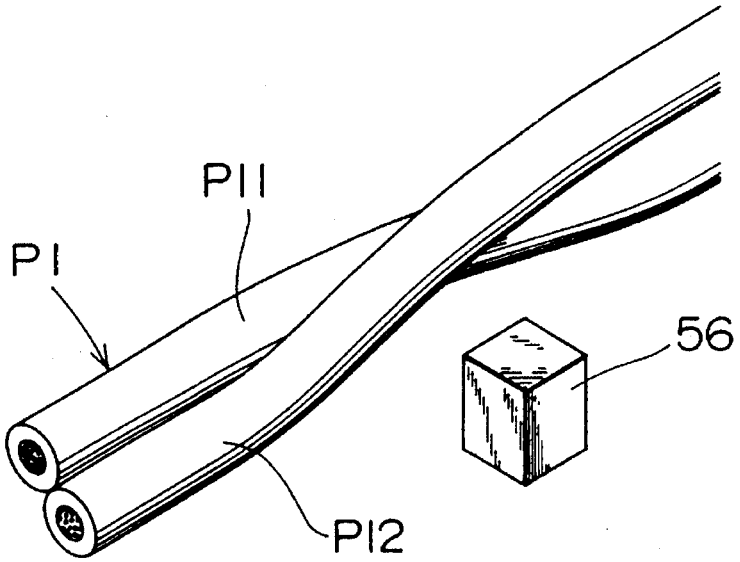
FIG. 9 is a schematic perspective view of an electric wire comprising two lead wires respectively having different colors, and a sensor for detecting a twist of the electric wire.
Figure 10:
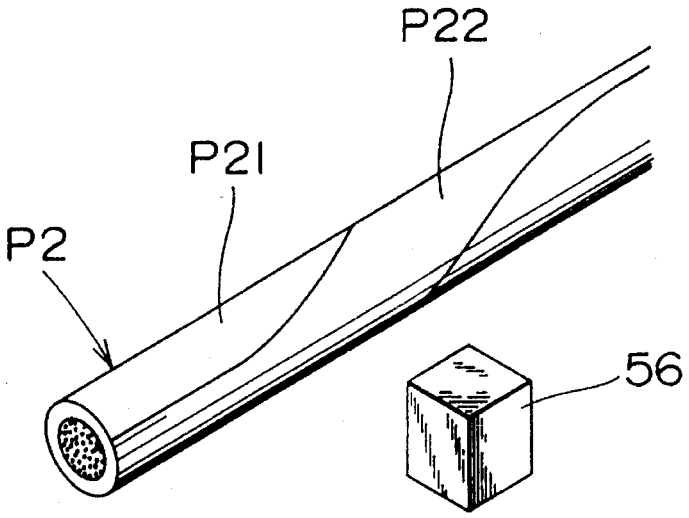
FIG. 10 is a schematic perspective view illustrating an electric wire having different colors, and a sensor for detecting a twist of the electric wire.

Further, as shown in FIG. 8, a twist amount or degree detecting sensor 56 for detecting a twist of the electric wire P may be disposed and the wire twist removing mechanism D may be arranged such that the speed at which the base member 2 is rotated, is automatically changed based on a detected twist amount (degree) of the electric wire P. In such a case, a color sensor 56 shown in each of FIGS. 9, 10 may be used as an example of the twist amount detecting sensor. However, such a color sensor can be used on the assumption that an electric wire P1 comprises, in a unitary structure, a plurality of lead wires P11, P12 respectively having different colors as shown in FIG. 9, or that an electric wire P2 comprises one lead wire colored in two different colors along the longitudinal direction thereof as shown in FIG. 10. The color sensor 56 may be disposed opposite to a predetermined portion of the electric wire P1 or P2 such that the color sensor 56 optically detects the color of such an opposite portion of the electric wire and supplies a signal to the control unit 5A. Then, the control unit 5A may calculate the number of color change times in a predetermined period of time and obtain a twist amount based on the number of color change times thus calculated. Based on the twist amount thus obtained, the control unit 5A may adjust the rotational cycle of the base member 2.

Further, the electric wire twist removing mechanism D may be used as applied to both electric wire bend correcting mechanisms B, C.

In addition, the electric wire twist removing mechanism D may be arranged as separated from the electric wire bend correcting mechanisms B, C. Thus, the present invention may be embodied in other specific forms without departing from the spirit or essential characteristics thereof.

What is claimed is:

1. An apparatus for removing a habitual tendency of an electric wire while the electric wire is being fed, said apparatus comprising:

a twist removing mechanism for removing a twist in an electric wire being fed;

said twist removing mechanism including:

a stationary member;

a rotary member supported in a manner rotatable around a predetermined axis of rotation by said stationary member;

electric wire holding means supported by said rotary member for holding the electric wire such that the electric wire travels along said axis of rotation;

a drive mechanism for rotatably driving said rotary member; and control means for controlling said drive mechanism to rotate said rotary member at a predetermined cycle in the direction opposite to a direction in which the electric wire is twisted, said electric wire holding means thereby twisting the wire in said opposite direction while holding the wire.

2. An apparatus for removing a habitual tendency of an electric wire according to claim 1, wherein said electric wire holding means comprises two-row roller groups disposed such that the travelling electric wire is held therebetween, each of said roller groups having at least two rollers.

3. An apparatus for removing a habitual tendency of an electric wire according to claim 2, wherein said rollers of said two-row roller groups are alternately disposed such that the electric wire travels in a zigzag manner for correcting a bend thereof.

4. An apparatus for removing a habitual tendency of an electric wire according to claim 3, wherein said control means is adapted to intermittently rotate said rotary member and also adapted to stop said rotary member at a home position when said rotary member is to be stopped, and said rollers of said two-row roller groups are adapted to correct a bend of the electric wire in one direction when said rotary member is located in said home position.

5. An apparatus for removing a habitual tendency of an electric wire according to claim 4, further comprising an electric wire bend correcting mechanism for correcting a bend of the electric wire which has passed through said twist removing mechanism, said bend being along a direction at a right angle to the one direction.

6. An apparatus for removing a habitual tendency of an electric wire according to claim 5, wherein said electric wire bend correcting mechanism includes:

two-row roller groups with each group having a plurality of rollers disposed such that the travelling electric wire is held by and between said two-row roller groups; and a base member which rotatably supports said rollers.

7. An apparatus for removing a habitual tendency of an electric wire according to claim 1, further comprising cycle setting means for setting the rotational cycle of said rotary member, and wherein said control means is adapted to rotate said rotary member at a rotational cycle set by said cycle setting means.

8. An apparatus for removing a habitual tendency of an electric wire according to claim 1, further comprising feeding speed detecting means for detecting the feeding speed of the electric wire, and wherein said control means is adapted to rotate said rotary member at a rotational cycle according to a feeding speed detected by said feeding speed detecting means.

9. An apparatus for removing a habitual tendency of an electric wire according to claim 1, further comprising twist degree detecting means for detecting a degree of twist in the electric wire being fed, and wherein said control means is adapted to rotate said rotary member at a rotational cycle according to a twist degree detected by said twist degree detecting means.

10. An apparatus for removing a habitual tendency of an electric wire according to claim 9, wherein said twist degree detecting means is a color detector for detecting colors of an electric wire having at least two colors and outputting a signal indicative of the number of times the color of the wire changes, said detecting means being located in opposition to a predetermined portion of the wire as the wire is being fed, and wherein said control means determines a degree of twist based upon a signal from said detecting means.

* * * * *